United States Patent [19]

Oberdorfer

[11] Patent Number: 4,545,732

[45] Date of Patent: Oct. 8, 1985

[54] RADIAL PISTON PUMP WITH A STAR-SHAPED CONNECTING PIECE

[76] Inventor: Guido Oberdorfer, Guido-Oberdorfer-Strasse 2-8, Bellenberg, Fed. Rep. of Germany, 7919

[21] Appl. No.: 512,433

[22] Filed: Jul. 8, 1983

[30] Foreign Application Priority Data

Jul. 15, 1982 [CH] Switzerland ..... 4295/82

[51] Int. Cl.[4] ..... F04B 1/04; F04B 49/00

[52] U.S. Cl. ..... 417/273; 417/307; 417/454; 92/148

[58] Field of Search ..... 417/269–273, 417/307, 312, 311, 454; 92/148, 72; 91/472, 492, 493

[56] References Cited

U.S. PATENT DOCUMENTS

| | | | |
|---|---|---|---|
| 790,624 | 5/1905 | Fancher | 92/148 X |
| 978,258 | 12/1910 | Zimmer | 417/273 |
| 2,255,851 | 9/1941 | Lundin | 417/273 |
| 2,539,277 | 1/1951 | Schroepfer | 417/221 |
| 2,545,791 | 3/1951 | Paget | 417/307 X |
| 2,683,422 | 7/1954 | Richards, Jr. | 91/493 |
| 2,801,596 | 8/1957 | Sewell | 417/311 X |
| 2,945,451 | 7/1960 | Griswold | 92/148 X |
| 2,978,149 | 4/1961 | Rosen | 417/307 |
| 4,381,179 | 4/1983 | Pareja | 417/273 |

FOREIGN PATENT DOCUMENTS

| | | | |
|---|---|---|---|
| 351803 | 5/1905 | France | 91/493 |
| 538375 | 3/1922 | France | 417/273 |
| 1191147 | 4/1959 | France | 417/273 |
| 1519 | of 1910 | United Kingdom | 417/273 |
| 341667 | 1/1931 | United Kingdom | 417/307 |
| 152613 | 9/1961 | U.S.S.R. | 417/273 |

*Primary Examiner*—William L. Freeh
*Assistant Examiner*—Paul F. Neils
*Attorney, Agent, or Firm*—Berman, Aisenberg & Platt

[57] ABSTRACT

The pump contains cylinders (1) which are arranged in the form of a star and which are attached to a molding (12) with valve cartridges (8 and 9) being interposed. This molding (12) consists of two sets of pipes (17 and 18) which are arranged in the form of a star. The suction channels (13) of the pump are formed in one of the sets of pipes (17). The delivery channels (14) are formed in the other of the pipe sets (18). The central ends of the suction channels (13) open into a cavity (15) which is located in the center of the molding (12) and which is provided with a screw sleeve (16) for attaching a suction line. The central ends of the delivery channels (14) are connected to one another in flow terms, and one of the delivery channels (14) is provided with an outflow orifice (23) for the fluid. The use of the molding mentioned makes it substantially simpler to connect the individual parts of the pump to one another and to the lines attached to the pump.

9 Claims, 6 Drawing Figures

FIG. 4
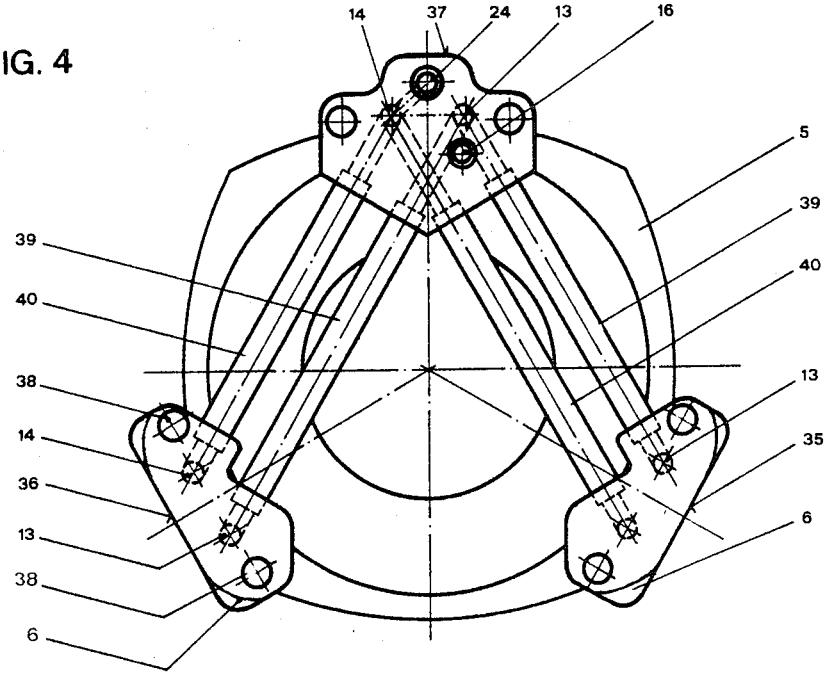
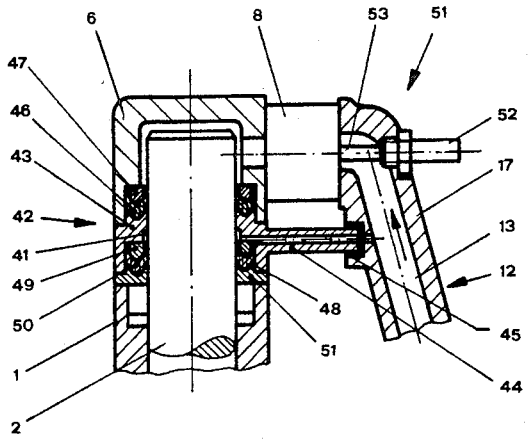
FIG. 5
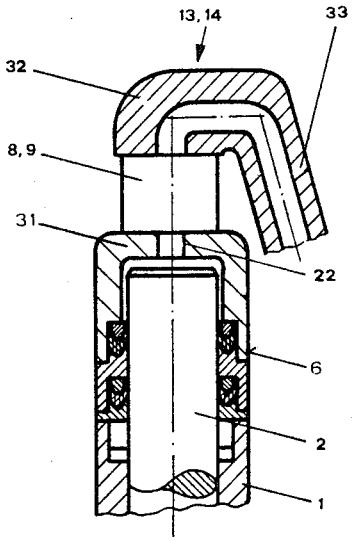
FIG. 3

RADIAL PISTON PUMP WITH A STAR-SHAPED CONNECTING PIECE

The present invention relates to a piston pump with at least two cylinders, with suction and delivery valves which are assigned in pairs to the cylinders, and with a suction line and delivery line which are connected to the cylinders via the said valves.

In a known piston pump of this type, the connection between the lines and a valves assigned to the particular cylinder is made by means of hoses. On the one hand, this is a labor-intensive method of making a connection between the said lines and the elements of the pump. On the other hand, because a considerable pressure can prevail in the hoses on the delivery side, the use of hoses involves a specific operating risk.

One of the objects of the present invention is to provide a piston pump with at least two cylinders which does not have the said disadvantages.

Embodiments of the present invention are described in more detail below with reference to the attached drawing in which:

FIG. 3 shows in a vertical section a further possibility for attaching the connecting piece to the cylinders of the pump according to FIG. 1, FIG. 4 shows a front view of a further possibility for designing the connecting piece attached to the cylinder heads of the pump according to FIG. 1, and FIG. 5 shows in a vertical section a development of the pump according to FIG. 1.

Figure 2:
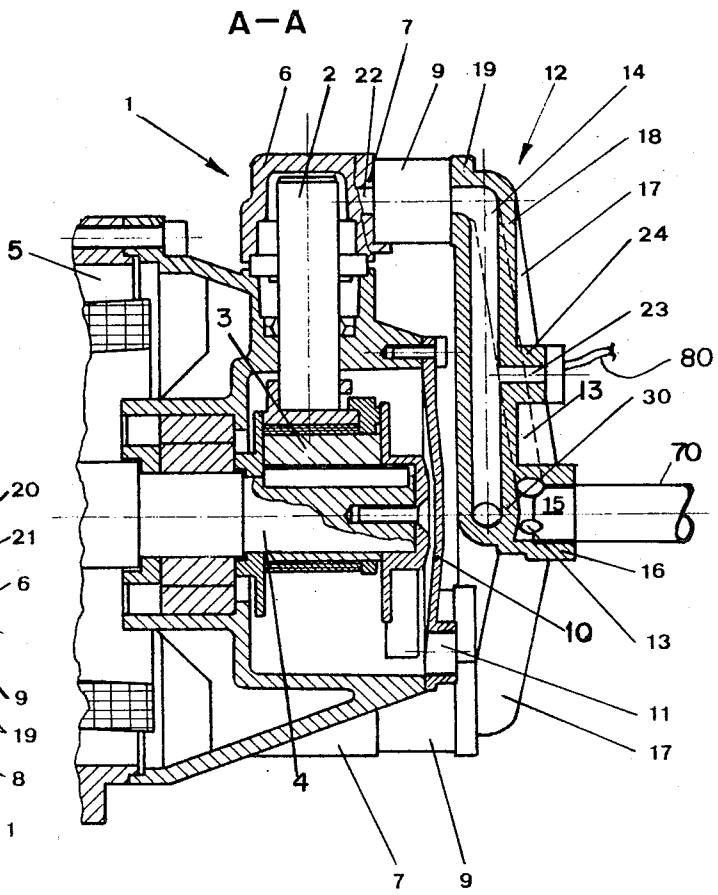
FIG. 2 shows the pump from FIG. 1 in a vertical section A—A.
Figure 1:
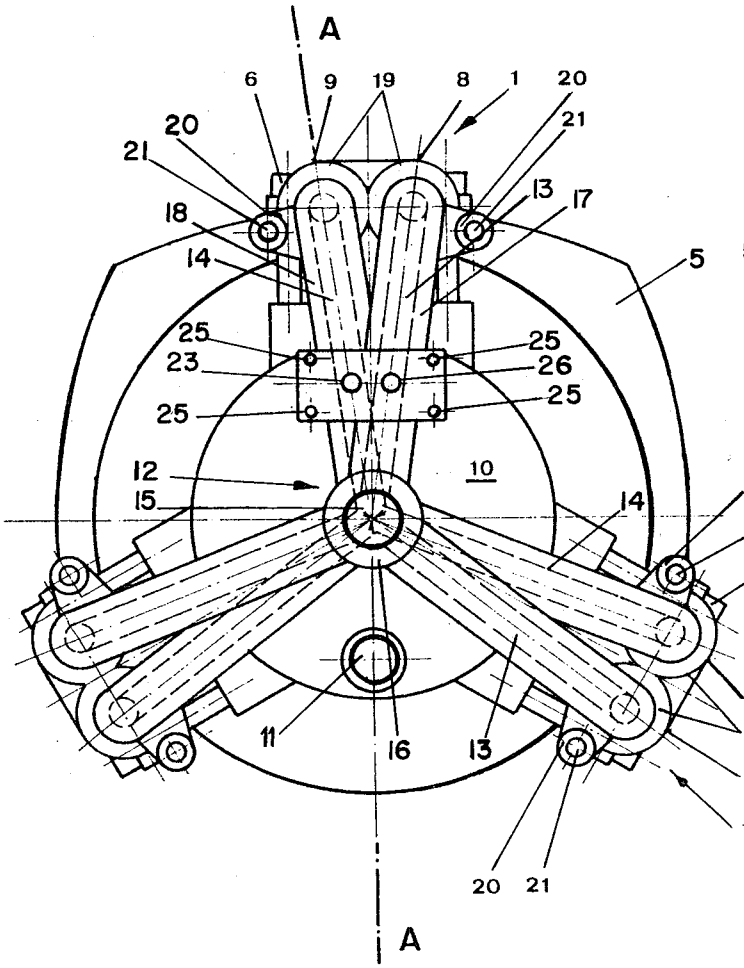
FIG. 1 shows in a front view the present pump with a star-shaped connecting piece for the cylinders of the pump.

The piston pump according to FIGS. 1 and 2 has cylinders 1 which are arranged in the form of a star and in which pistons 2 are located. The pistons 2 are under the effect of a cam 3 which rests on the shaft 4 of an electric motor 5. The flange 7 for receiving valves 8 and 9 is formed on the particular cylinder head 6.

A cover 10 with an oil drain 11 is attached in the central part of the pump housing. Above this cover 10, a connecting piece 12 designed as a molding is attached to the front side of the arrangement already described. This molding 12 contains suction channels 13 and delivery channels 14 which likewise extend in the form of a star in a manner corresponding to the arrangement of the cylinders 1. One end of each of the suction channels 13 opens into a cavity 15 formed in the molding 12. The molding 12 has in the region of the cavity 15 a threaded sleeve 16 by means of which the suction line 70 is connected to the pump.

The molding 12 can be designed, in principle, as a plate in which the channels 13 and 14 extend in the form of a star. It is also possible, however, instead of a plate, merely to arrange pipes in the form of a star and connect these to one another so that the channels 13 and 14 limited by these pipes are connected to one another in the requisite manner. Such an embodiment of the molding 12 is illustrated in the drawing. The first pipes 17 limit the suction channels 13 and the second pipes 18 limit the delivery channels 14. The ends of the suction pipes 17 located in the central region of the pump open into the cavity 15. The corresponding ends of the delivery pipes 18 are connected to one another in terms of flow in the central region of the pump, but they are not connected to the cavity 15. The pipes 17 having the suction channels 13 and the pipes 18 having the delivery channels 14 are designed as two star-shaped pipe sets. Although these pipe sets are arranged concentrically and are connected firmly to one another in the central region, they are nevertheless located behind one another, as may best be seen in FIG. 2. The cavity 15 is separated from the delivery channels 14 by the wall 30.

So that a simple connection of the outer ends of the pipes 17 and 18 to the particular cylinder head 6 is obtained, the pipes 17 of one pipe set are arranged offset to one another in the peripheral direction in relation to the pipes 18 of the other pipe set. As a result, the suction channel 13 is at an angle to that delivery channel 14 which communicates with the same cylinder 1. The end parts of the pipes 17 and 18 which are located in the peripheral region of the pump can then lie next to one another. They are provided with flanges 19, the end faces of which lie in the same plane. These flanges 19 are located opposite the respective flange 7 on the cylinder head 6. Moreover, the said end parts of the pipes 17 and 18 are provided with spurs 20 in which bores 21 for receiving screws (not shown) are provided. The pairs of valves 8 and 9 are located between the flanges 7 and 19 and are clamped by means of the said screws which are screwed into the cylinder head 6. The connection between the valves 8 and 9 respectively and the interior of the cylinder is made by means of orifices 22 (FIG. 2) which are formed in the cylinder head and in the flange 7.

One of the delivery channels 14 connected to one another in flow terms is provided with a through-orifice 23 which permits the outflow of the fluid under pressure, that is to say water, air or the like. This orifice 23 passes through a deadhead 24 in which threaded holes 25 for fastening the delivery line 80 are formed.

If the flow-off of fluid from the delivery line were to be interrupted for any reason, the pressure in the delivery line would reach inadmissible values. To prevent this, a so-called bypass device is normally inserted between the delivery line and the pump. When the pressure in the delivery line exceeds a predetermined value, the bypass device conveys the fluid back into the suction line.

Figure 1A:
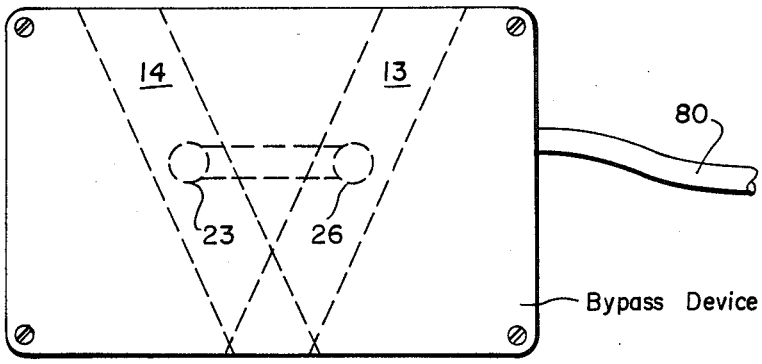
FIG. 1A shows a part of FIG. 1 and illustrates a bypass device installed on the present pump.

The above-described arrangement of suction and delivery channels 13 and 14 allows the bypass device to be attached to the pump in an especially advantageous way as seen in FIG. 1A. As already stated, a suction channel 13 and a delivery channel 14 which lie close to one another lead to each particular cylinder. We have also mentioned that one of the delivery channels 14 is provided with the outflow orifice 23. A further orifice 26 can be formed in the adjacent suction channel 13. In the example illustrated, one suction pipe 17 is provided with the orifice 26 and is assigned to the same cylinder 1 as the delivery channel 14 or delivery pipe 18 with the orifice 23. The bypass device is fastened to the pump by means of screws (not shown) which penetrate into the holes 25. The inlet orifice and the return orifice of the bypass device communicate with the orifices 23 and 26 in the channels of the pump. The delivery line is first connected to the bypass device. In this way, the bypass device bridges the two orifices 23 and 26 mentioned, and it allows the fluid to be conveyed back into the suction part of the pump in the event that a pressure which is still permissible is exceeded in the delivery line.

The valves 8 and 9 can be designed as described, for example, in German Offenlegungsschrift No. 2,753,370.

During the running of the machine described, the pressure in the interior of the cylinders reaches very high values, and these pressure values change rapidly according to the to-and-fro movement of a particular piston. This causes severe stressing of the fastening means retaining the cylinder head on the cylinder. When the valves are attached laterally to the cylinder head, the pumped fluid also causes a rapidly changing lateral stress on the fastening means for the cylinder head. Such a combined stress on the said fastening means could result in disturbances in pump running when the engine is in operation over a long period of time.

A further object of the present invention is, therefore, to design the pump so that the combined stress on the said fastening means does not occur.

For this purpose, the orifices 22 are formed in the end wall 31 of the cylinder head 6 (FIG. 3), whereas in the embodiment of the pump described above the said orifices 22 were formed in the side wall of the cylinder head 6. The valves 8 and 9, which have already been mentioned, are located in the form of cartridges on the end wall 31 of the cylinder head 6. The end part of the particular channel 13 or 14 respectively is located on these valve cartridges 8 and 9. However, these end parts are designed a little differently from those in the above-described embodiment of the present pump. Whereas before that portion of the channel 13 or 14 which has the mouth resting on the valve cartridges 8 and 9 respectively was approximately at right angles to the remaining part of the channel, in this development of the pump this portion 32 of the channel 13 and 14 forms a sharp angle with the remaining part 33 of the channel 13 and 14 respectively. As regards the remaining part 33 of the channel 13 and 14, the said end portion 32 of the channel 13 or 14 now consequently extends almost in the opposite direction. The connection between the end portion 33 of the channels 13 and 14 and the cylinder head 6 is, again, made by means of flanges and screws, specifically essentially as described above. At the same time, the tension screws can be so long that they extend into the cylinder 1.

In the embodiment of the pump just described, the pressure in the interior of the cylinder 1, which is caused by the movement of the pistons 2, and the load exerted by the flowing fluid stress the cylinder head 6 and consequently also its fastening means in the same direction, specifically in the axial direction of the cylinder 1. Such stressing can easily be absorbed by giving the said screws suitable dimensions. Moreover, in this case, one set of flanges and screws is saved, for in the pump described above a second set of flanges and screws is also required for fastening the cylinder head 6 to the cylinder 1.

The connecting piece which connects the individual cylinder heads 6 to one another and then these to the suction and delivery lines can be designed in an even more appropriate way. The connecting piece according to FIG. 4 contains individual moldings 35,36 and 37 which are fastened to the cylinder heads 6 by means of tension screws 38 and with the valve cartridges 8 and 9 being interposed as already described. Such a molding 35,36 and 37 is thus assigned to each cylinder head 6. Suction channels 13 and delivery channels 14 which are connected at one end to the valves 8 and 9 already mentioned are formed in these moldings 35, 36 and 37. However, the moldings 35,36 and 37 are only large enough still to cover the cylinder head 6. The connection between such moldings 35, 36 and 37 is made by means of pipes 39 and 40. The end parts of these pipes 39 and 40 are inserted in the moldings, specifically in such a way that the end parts of the pipes 39 and 40 adjoin the other end of the suction channel 13 or delivery channel 14 respectively in the particular molding 35, 36 and 37.

It would seem to be clear that requirements demanded of the material of the connecting piece in the region of the cylinder heads 6 and in the region of the connecting tubular portions of these are different. In the embodiment of the connecting piece which has just been described, this fact can be taken into account better than was the case in the connecting piece according to FIGS. 1 and 2.

An especially advantageous design of this connecting piece is obtained by designing one of the moldings 37 in such a way that the pipes 39 and 40 of all the remaining moldings 35 and 36 end in this molding 37. At the same time, this central molding 37 is provided with the already mentioned threaded sleeve 16 for connecting the suction line and with the connection 24 for fastening the delivery line. As is evident from FIG. 4, the left-hand delivery channel 14 from the right-hand molding 35 overlaps the right-hand suction channel 13 to the left-hand molding 36.

During a long period of operation of the pump, the piston packing in the cylinder can be worn. The result of such wearing of the packing is that the fluid can pass out of the space located in front of the piston 2 along the piston 2 up to the cam 3 of the pump. This can result in breakdown of the pump. To prevent this, the measure evident from FIG. 5 can be carried out on the pump.

The piston packing 42 located between the cylinder 1 and the cylinder head 6 has a cylindrical basic body 43 which is provided with a through-orifice for the piston 2. The wall of this through-orifice is provided with a continuous groove 41 which opens into the interior of the basic body 43. There extends from the basic body 43 a pipe 44, the interior of which adjoins the cavity limited by the said groove 41. The other end of this pipe 44 passes through the wall of the first pipe 17 of the connecting pieces 12 according to FIGS. 1 and 2 respectively and opens into the suction channel 13. The end of the connecting pipe 44 located in the wall of the first pipe 17 of the connecting piece 12 is provided with a gasket 45 so that no ambient air can be sucked in at this point. Gaskets 46 and 47 resting on top of one another are located between the cylinder head 6 and the basic body 43. Located in a recess 48 in the opposite end part of the basic body 43 are two further gaskets 49 and 50 which are compressed between the basic body 43 and a counter piece 51 which rests on the cylinder 1 and which projects into the recess 48.

When the cylinder head 6 is pressed against the cylinder 1 by means of fastening means (not shown), the gaskets 46,47,49 and 50 rest against the piston in a leak-proof manner. The fluid which under certain circumstances penetrates into the zone of the groove 41 located behind the first gasket set 46,47 is sucked up from here out of the groove 41 by means of the connecting pipe 44 under the effect of the partial vacuum in the suction channel 13 and is conveyed back into the cylinder head 6. The gaskets 49 and 50 of the lower gasket set will ensure additionally that the fluid does not penetrate to the cam 3. However, these gaskets 49 and 50 will also ensure that, if possible, no lubricant penetrates from the cam 3 into the piston/cylinder space.

It is often necessary for another substance, such as, for example, a chemical or a washing agent, to be admixed with the fluid in a very specific ratio. This can be achieved in a simple way if there is in the suction channel 13 a pipe 51, the outer end 52 of which is connected via a dosing device to a supply vessel (not shown) for the substance to be admixed. The mouth of the end 53, located in the suction channel 13, of the admixing pipe 51 lies in the same plane as the mouth of the suction channel 13 to which the valve 8 is assigned. The reduction in the cross-section of the said mouth of the suction channel 13, which is caused by the presence of the inner end 53 of the admixing pipe 51 in the mouth of the suction pipe 13, results in a pressure drop in front of the mouth of the admixing pipe 51. This partial vacuum makes it possible for the substance to be admixed to be introduced from the supply vessel into the suction channel 13 and thus also into the fluid.

I claim:

1. A radial piston pump with at least two cylinders (1), comprising: a suction valve (8) and a delivery valve (9) mounted as a pair to each of the cylinders (1) such that all valves are similarly mounted on the same side of respective cylinders (1);

a suction line and a delivery line;

a set of suction channels (13), disposed within pipes (17), connecting the suction line to each of the suction valves (8);

a set of delivery channels (14), disposed within pipes (18), connecting each of the delivery valves (9) to the delivery line, said pipes (17, 18) having outer end parts, including an external flange (19), and each of said cylinders having an external surface, including an external flange (7), wherein said sets of channels are arranged concentrically on the side of said cylinders to which said valves are mounted, and wherein each valve (8, 9) is clamped between and has end surfaces which abut against said external flanges (7, 19), such that a pair of channels comprising a suction channel and a delivery channel is connected to each cylinder, said channels being connected firmly to one another in a central region, and wherein the suction channels (13) and the delivery channels (14) extend in a connecting piece (12) in the form of a star in a manner corresponding to the arrangement of the cylinders (1), one end of each of the suction channels (13) opens into a cavity (15) in the connecting piece (12) to which said suction line is connected, the delivery channels (14) are in fluid connection with one another in a central region of the connecting piece (12), and one of the delivery channels (14) has a through-orifice (23) for connecting the delivery channels (14) to the delivery line.

2. A radial piston pump as in claim 1 wherein said connecting piece (12) comprises a plate in which said sets of suction and delivery channels (13,14) extend in the form of a star.

3. A radial piston pump as in claim 1 wherein said sets of channels are disposed in said connecting piece off-set to one another such that each suction channel (13) is at an angle to its respective delivery channel (14).

4. A radial piston pump as in claim 1 wherein respective suction channels (13) and delivery channels (14) in connection with each piston (1) form an angle, said channels having outer end parts in fluid connection with respective cylinders (1), and wherein said valves assigned in pairs to respective cylinders (1) are clamped between the outer end parts of said channels and a respective cylinder.

5. A radial piston pump as in claim 4 wherein the outer end parts of said channels (13,14) are connected to a side wall of a respective cylinder head (6).

6. A radial piston pump as in claim 1 wherein said connecting piece (12) comprises first and second sets of pipes (17,18) wherein the suction channels (13) are within the pipes of said first pipe set and the delivery channels (14) are within the pipes of the second pipe set.

7. A radial piston pump as in claim 6 wherein said pipe sets comprise two star-shaped sets, the second set being located behind the first, substantially between the first set and the cylinders (1).

8. A radial piston pump as in claim 6 wherein said cavity (15) is separated from the delivery channels (14) by a wall (30).

9. A radial piston pump with at least two cylinders (1), comprising: a suction valve (8) and a delivery valve (9) mounted as a pair to each of the cylinders (1) such that all valves are similarly mounted on the same side of respective cylinders (1);

a suction line and a delivery line;

a set of suction channels (13) connecting the suction line to each of the suction valves (8);

a set of delivery channels (14) connecting each of the delivery valves (9) to the delivery line, wherein said sets of channels are arranged concentrically on the side of said cylinders to which said valves are mounted, such that a pair of channels comprising a suction channel and a delivery channel is connected to each cylinder, said channels being connected firmly to one another in a central region, and wherein the suction channels (13) and the delivery channels (14) extend in a connecting piece (12) in the form of a star in a manner corresponding to the arrangement of the cylinders (1), one end of each of the suction channels (13) opens into a cavity (15) in the connecting piece (12) to which said suction line is connected, the delivery channels (14) are in fluid connection with one another in a central region of the connecting piece (12), and one of the delivery channels (14) has a through-orifice (23) for connecting the delivery channels (14) to the delivery line, a suction channel (13) which is attached to the same cylinder (1) as the delivery channel (14) having through-orifice (23) has an orifice (26), the orifices (23, 26) being connected to one another by means of a bypass device and the delivery line being attached to the bypass device.

* * * * *